US006958643B2

(12) United States Patent
Rosenthal

(10) Patent No.: US 6,958,643 B2
(45) Date of Patent: Oct. 25, 2005

(54) FOLDED CASCODE BANDGAP REFERENCE VOLTAGE CIRCUIT

(75) Inventor: Bruce Rosenthal, Los Gatos, CA (US)

(73) Assignee: Analog Microelectrics, Inc., Santa Clara, CA (US)

( * ) Notice: Subject to any disclaimer, the term of this patent is extended or adjusted under 35 U.S.C. 154(b) by 94 days.

(21) Appl. No.: 10/621,747

(22) Filed: Jul. 16, 2003

(65) Prior Publication Data

US 2005/0012493 A1 Jan. 20, 2005

(51) Int. Cl.[7] ..... G05F 1/10; G05F 3/20

(52) U.S. Cl. ..... 327/540; 327/157; 330/296; 323/313

(58) Field of Search ..... 323/312, 315, 323/273, 280, 313, 314; 327/540, 545, 538, 539, 542, 157, 154; 330/296, 283, 311

(56) References Cited

U.S. PATENT DOCUMENTS 4,851,953 A * 7/1989 O'Neill et al. ..... 361/101
5,847,614 A * 12/1998 Gilbert et al. ..... 331/14
5,966,005 A * 10/1999 Fujimori ..... 323/315
6,292,050 B1 * 9/2001 Dooley et al. ..... 327/540

* cited by examiner

*Primary Examiner*—Rajnikant B. Patel
(74) *Attorney, Agent, or Firm*—Bever, Hoffman & Harms, LLP; Jeanette S. Harms

(57) ABSTRACT

A bandgap reference voltage circuit can advantageously maximize performance, i.e. provide a stable output voltage as a function of input supply voltage and/or temperature. The bandgap reference voltage circuit can include a modified Brokaw cell and a cascode amplifier. The modified Brokaw cell can include two transistors, each transistor including a base, an emitter, and a collector. The collectors of the transistors can be folded into input terminals of the cascode amplifier, thereby providing an extremely compact circuit implementation. In one embodiment, the Brokaw cell can include two lateral PNP (LPNP) transistors, thereby allowing manufacturing of the bandgap reference voltage circuit with standard CMOS technology. Of importance, an output of the bandgap reference voltage circuit can provide a source voltage to the cascode amplifier, thereby ensuring a stable voltage source to the circuit.

23 Claims, 9 Drawing Sheets

FOLDED CASCODE BANDGAP REFERENCE VOLTAGE CIRCUIT

BACKGROUND OF THE INVENTION

1. Field of the Invention

This invention relates generally to a bandgap reference voltage circuit and in particular to a bandgap reference voltage circuit having a modified Brokaw cell configuration with a folded cascode operational amplifier. This circuit, which can be advantageously implemented in CMOS technology, can provide optimal voltage regulation.

2. Description of the Related Art

In general, a reference voltage is provided to maintain a baseline voltage level for an electronic circuit. Of importance, other voltages, power levels, and/or signals within the electronic circuit rely upon this baseline voltage level. Therefore, this reference voltage must be as consistent and as precise as possible, even when exposed to varying conditions (e.g. temperature).

One type of reference voltage circuit is a bandgap reference voltage circuit. A bandgap reference voltage circuit is typically preferred over other reference voltage circuits because of its relative simplicity and elimination of zener diodes, which can generate undesirable noise. Of importance, a bandgap reference voltage circuit can generate a reference voltage commensurate with ever-decreasing system voltages. For example, a bandgap-reference voltage circuit can produce an output voltage that is approximately equal to the silicon bandgap voltage of 1.206 V with a zero temperature coefficient (TC).

FIG. 1 illustrates a basic bandgap reference voltage-circuit 100 that can generate differing current densities between matched transistors 102 and 104, thereby producing a $\Delta V_{BE}$ across resistor 105. In one embodiment, resistors 101, 103, and 105 can have resistances of 600 Ohms, 6 k Ohms, and 600 Ohms, respectively. Bandgap reference voltage circuit 100 sums the $V_{BE}$ of transistor 106 with the amplified $\Delta V_{BE}$ of transistors 102 and 104 to generate $V_R$. The components have opposite polarity TCs, i.e. $\Delta V_{BE}$ is proportional-to-absolute-temperature (PTAT), whereas $V_{BE}$ is complementary-to-absolute (CTAT). In this manner, the summed output $V_R$, when it is equal to 1.205 V (i.e. the silicon bandgap voltage), the TC is effectively minimized.

Unfortunately, bandgap reference voltage circuit 100 suffers from load and current drive sensitivity. Moreover, reference voltage $V_R$ needs accurate scaling to provide useful voltage levels (e.g. 2.5 V, 5.0 V, etc.)

FIG. 2 illustrates a type of bandgap reference voltage circuit 200, which is commonly called a "Brokaw cell". Brokaw cell 200 improves on bandgap reference voltage circuit 100 by including an operational amplifier 207, which provides additional drive capability as well as convenient voltage scaling.

In this embodiment, Brokaw cell 200 includes two emitter-scaled transistors 202 and 206 (which form the bandgap core) that operate at identical collector currents due to equal load resistors 201 and 205 and a closed loop associated with operational amplifier 207. Assuming a smaller $V_{BE}$ of transistor 202 (e.g. transistor 202 can have 8× area of transistor 206), resistor 203 in series with transistor 202 drops the $V_{BE}$ voltage. Resistor 204, in turn, drops a PTAT voltage V1 according to the following equation, wherein R204 and R203 refer to the resistances of resistors 204 and 203, respectively.

$$V1=2\times(R204/R203)\times\Delta V_{BE}$$

Resistors 208 and 209 (e.g. laser-trimmed resistors) in combination with operational amplifier 207 can be used to scale voltage $V_{OUT}$ The bandgap reference voltage $V_Z$ is generated at the base of transistor 206 by summing $V_{BE}$ and V1.

FIG. 3 illustrates a shunt mode reference voltage circuit 310, which functions similarly to bandgap reference voltage circuit 100. In circuit 310, like transistors 314 and 321 can be operated at a current ratio of 5×, as determined by the ratio of resistances of resistor 320 to resistor 312. An operational amplifier can be formed by the differential pair (i.e. transistors) 317 and 318, current mirror 316, resistors 315 and 322, and drivers (i.e. transistors) 323 and 324. In closed loop equilibrium, this operational amplifier maintains the bottom ends of resistors 312 and 320 at the same potential. In the configuration of circuit 310, $\Delta V_{BE}$ is generated across resistor 313, $V_{BE}$ is formed across transistor 314, and V1 is provided across transistors 311 and 312. The nominal bandgap reference voltage can be computed by summing $V_{BE}$ and V1.

Unfortunately, implementing bandgap reference voltage circuits 100 and 310 using bipolar technology may significantly decrease the amount of digital circuits that can be placed on the same integrated circuit (IC). Specifically, a bipolar transistor has a parasitic collector to the substrate, which would otherwise interfere with CMOS device operation. Therefore, bipolar and CMOS devices must be isolated, if provided on the same IC, to ensure functionality. In another embodiment, separate ICs can be provided for bipolar and CMOS devices, thereby also undesirably increasing wafer production cost.

In yet another embodiment, bandgap reference voltage circuits 100 and 310 can be manufactured using biCMOS technology. Unfortunately, using this technology can also effectively double the cost of producing a wafer. Specifically, biCMOS technology requires the use of several additional layers in the IC, thereby increasing production costs and also reducing yield.

Brokaw cell 200 (FIG. 2) can be implemented in CMOS technology. Unfortunately, operational amplifier 207 derives its source voltage from the input voltage $V_{IN}$. In this configuration, i.e. with its control terminal coupled to $V_{IN}$, any variation in input voltage can also affect amplifier 207, thereby adversely affecting the stability of the bandgap reference voltage $V_Z$. Specifically, even a few millivolts of offset introduced in operational amplifier 207 can result in an inability to accurately detect the voltage differential between its positive and negative input terminals. This detection problem, called power supply rejection (PSR), can render Brokaw cell 200 inapplicable for any system in which the input voltage may vary. Unfortunately, most systems have some variation in input voltage, either intentionally or unintentionally.

Therefore, a need arises for a bandgap reference voltage circuit that can be manufactured in CMOS technology while preserving the accuracy of the bandgap reference voltage irrespective of input voltage variations.

SUMMARY OF THE INVENTION

In accordance with one aspect of the invention, a bandgap reference voltage circuit can advantageously maximize performance, i.e. provide a stable output voltage as a function of input supply voltage and/or temperature. The bandgap reference voltage circuit can include a modified Brokaw cell and a cascode amplifier. The modified Brokaw cell can include two transistors, each transistor including a base, an emitter, and a collector. The collectors of the transistors can be folded into input terminals of the cascode amplifier, thereby providing an extremely compact circuit implementation. In one embodiment, the Brokaw cell can include two lateral PNP (LPNP) transistors, thereby allowing manufacturing of the bandgap reference voltage circuit with standard CMOS technology.

Of importance, the source voltage to the cascode amplifier can be advantageously tied to the output of the bandgap reference voltage circuit. That is, the cascode amplifier can operate using the bandgap reference voltage (i.e. 1.2 V). By using this source voltage, which is ensured to be stable, the cascode amplifier will remain unaffected by any variation in the input voltage.

The bandgap reference voltage circuit can also include a stabilizing device for providing loop stability to the cascode amplifier. In one embodiment, the stabilizing device can include a transistor configured with its source, drain, and substrate coupled to an input voltage source and its gate coupled to the cascode amplifier. In another embodiment, the stabilizing device can include a capacitive device having one terminal coupled to an input voltage source and another terminal coupled to the cascode amplifier. The bandgap reference voltage circuit can further include a shunt device coupled to receive an output of the cascode amplifier. The shunt device can generate a regulated output of the bandgap reference voltage circuit.

In one embodiment, the cascode amplifier can include first, second, third, and fourth NMOS transistors. A drain of the first NMOS transistor can be connected to a source of the third NMOS transistor and to a first input terminal of the cascode amplifier, a drain of the second NMOS transistor can be connected to a source of the fourth NMOS transistor and a second input terminal of the folded cascode amplifier, and sources of the first and second NMOS transistors can be connected to a low voltage source VSS. The substrates of the first, second, third, and fourth NMOS transistors can be connected to VSS. The gates of the first, second, third, and fourth NMOS transistors and a drain of the third NMOS transistor can be connected to a common node, which is connected to the bias current source. A drain of the fourth NMOS transistor can be connected to an output terminal of the folded cascode amplifier.

The cascode amplifier can further include a bias current circuit coupled in operative relation to a regulated voltage source and the Brokaw cell. The bias current circuit can include first, second, and third PMOS transistors and a resistor. In one embodiment, the substrates and sources of the first, second, and third PMOS transistors can be connected to the regulated voltage source, the resistor can be connected between VSS and the gates of the first, second, and third PMOS transistors. The drain of the first PMOS transistor can be connected to the resistor, a drain of the second PMOS transistor can be connected to the common node, and a drain of the third PMOS transistor can be connected to the output terminal of the cascode amplifier.

In accordance with one aspect of the invention, the bandgap reference voltage circuit, which is a three-terminal circuit, can be considered a shunt regulator, i.e. a two-terminal circuit, with another terminal added via one of a resistor or current source.

DETAILED DESCRIPTION OF THE FIGURES

Figure 1:
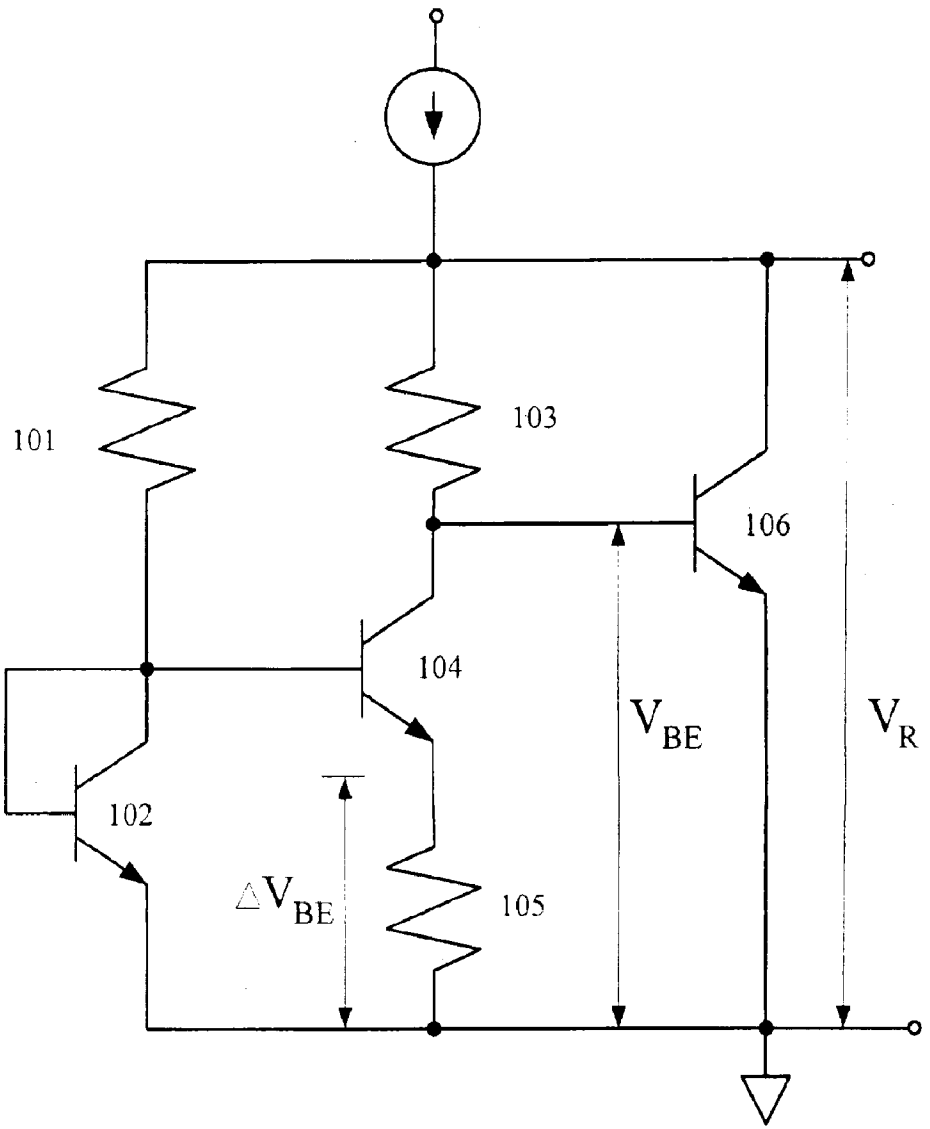
Figure 1 Prior Art
FIG. 1 illustrates a simple bandgap reference voltage circuit.
Figure 2:
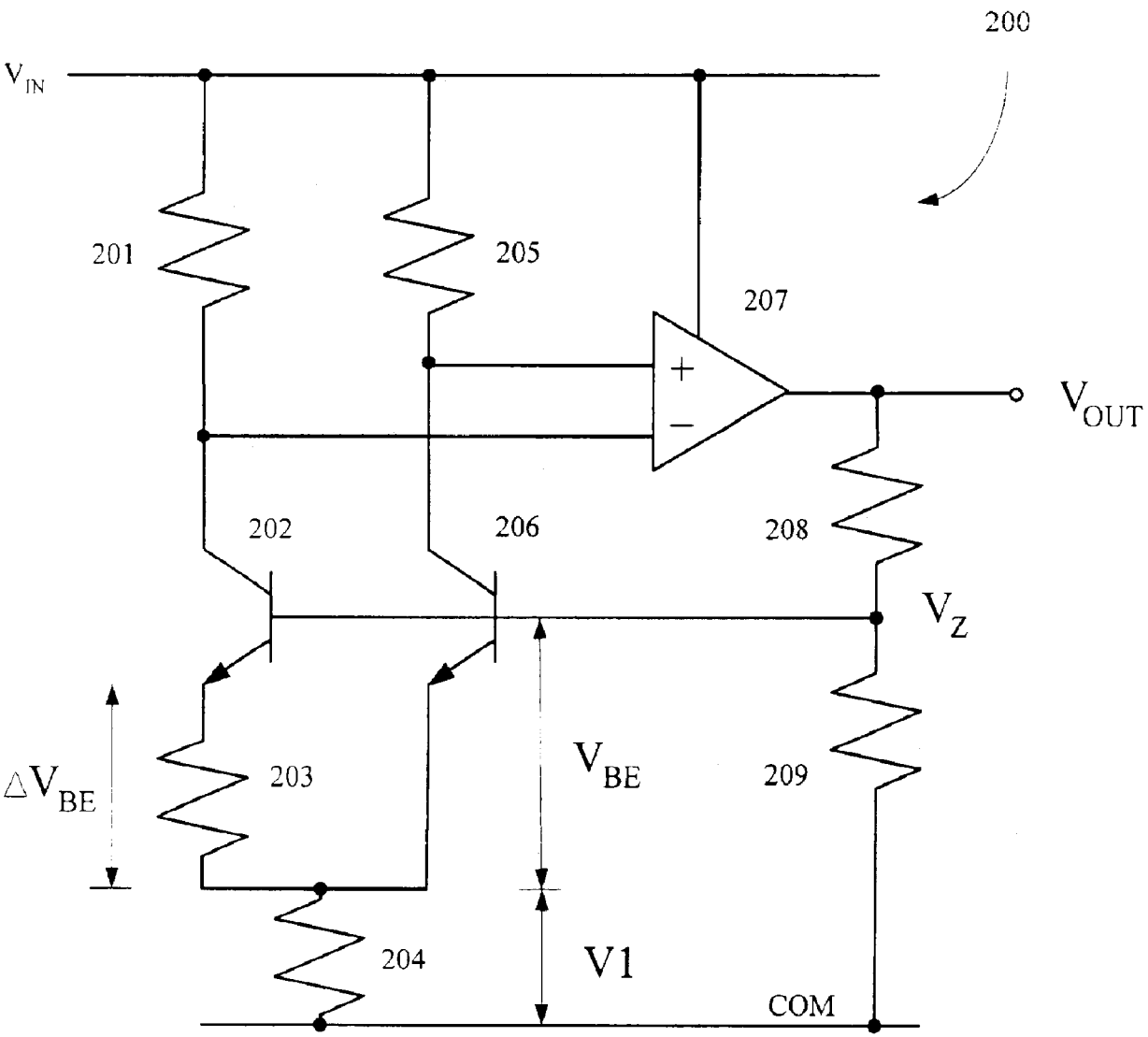
Figure 2 Prior Art
FIG. 2 illustrates another known bandgap reference voltage circuit called a Brokaw cell.
Figure 3:
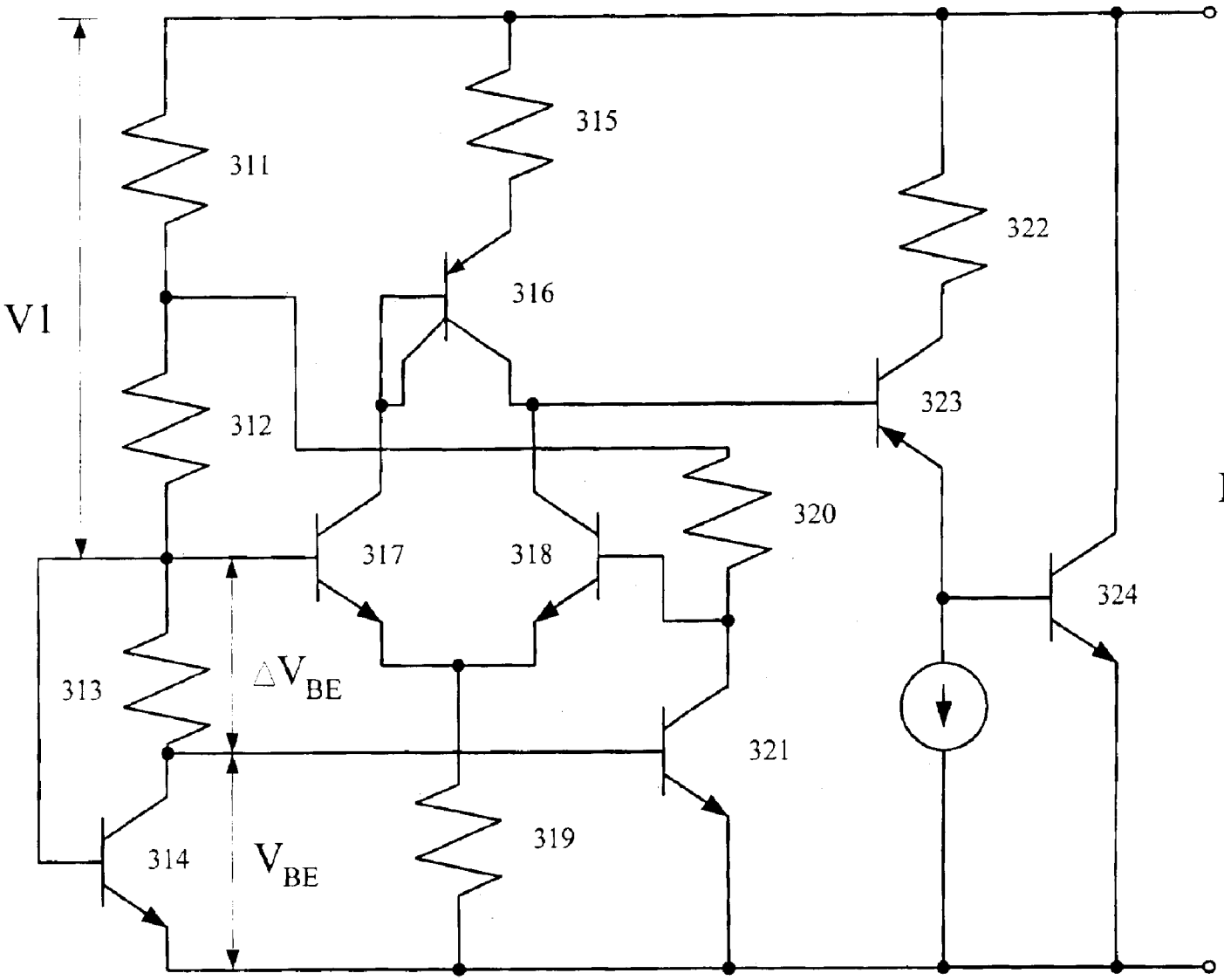
Figure 3 Prior Art
FIG. 3 illustrates a known shunt type bandgap reference voltage circuit.
Figure 4:
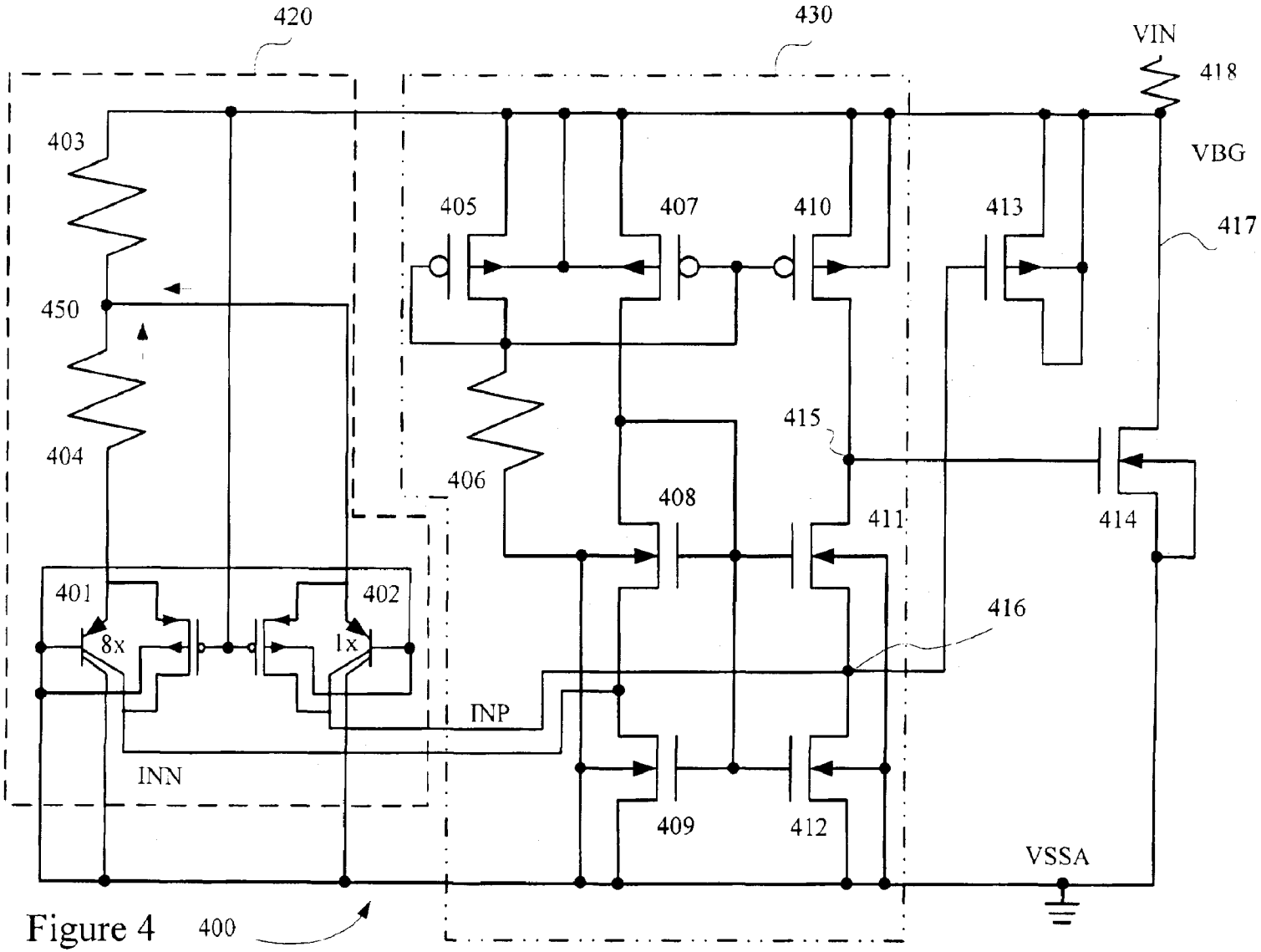
FIG. 4 illustrates one embodiment of a bandgap reference voltage circuit that can be manufactured in CMOS technology while preserving the accuracy of the bandgap reference voltage.

FIG. 4 illustrates a bandgap reference voltage circuit 400 that can preserve the accuracy of the bandgap reference voltage irrespective of input voltage and temperature variations. In bandgap reference voltage circuit 400, an LPNP (lateral PNP) transistor 401, an LPNP transistor 402, a resistor 403, and a resistor 404 form a modified Brokaw cell 420. In this embodiment, the emitter of LPNP transistor 401 is connected resistor 404, the emitter of LPNP transistor 402 is connected to node 450, which is located between resistors 403 and 404, and resistor 403 is further connected to the output of bandgap reference voltage circuit 400, i.e. line 417.

In this embodiment, the bases of LPNP transistors 401 and 402 are connected to the substrates of NMOS transistor 408, 409, 411, and 412 (in this case, low voltage source VSS), whereas the collectors of LPNP transistors 401 and 402 are connected to the drains of NMOS transistors 409 and 412, respectively. Of importance, the collectors of PNP transistors 401 and 402 respectively are "folded" in such a way to form the negative (INN) and the positive (INP) input terminals of a cascode amplifier 430. As described in reference to FIGS. 7A and 7B, LPNP transistors 401 and 402 can be advantageously implemented in CMOS technology.

In this embodiment, cascode amplifier 430 can include four NMOS transistors 408, 409, 411, and 412, three PMOS transistors 405, 407, and 410, and a resistor 406. In the configuration shown, PMOS transistors 407 and 410 form matching current sources for cascode amplifier 430. In another embodiment, PMOS transistors 407 and 410 could be replaced by matching resistors or other appropriate devices to provide the desired functionality. PMOS transistor 405 in combination with resistor 406 can provide a bias to the current sources formed by PMOS transistors 407 and 410.

Of importance, the source voltage to cascode amplifier 430 (referring to the substrates of PMOS transistors 407 and 410) can be advantageously tied to the output of bandgap reference voltage circuit 400, i.e. line 417. That is, cascode amplifier can operate using the bandgap reference voltage VBG (i.e. 1.2 V). By using this source voltage, which is ensured to be stable, cascode amplifier 430 will remain unaffected by any variation in the input voltage Vin.

In this embodiment, the gates of NMOS transistors 408, 409, 411, and 412 are commonly coupled to the drain of NMOS transistor 408. Moreover, the sources of NMOS transistors 409 and 412 are connected to voltage source VSSA (e.g. ground). In this configuration, NMOS transistors 409 and 412 can provide active pull-down loads for cascode amplifier 430. Thus, in one embodiment, resistors could replace NMOS transistors 409 and 412. In yet another embodiment, the gates of NMOS transistors 409 and 412 could be tied to a DC biasing point.

Note that other embodiments of a cascode amplifier could be used in combination with modified Brokaw cell 420. Other exemplary folded cascode amplifiers are described in, for example, pages 421–423 of "CMOS Analog Circuit Design", authored by Phillip E. Allen and Douglas R. Holberg, and published in 1987 by Holt, Rinehart and Winston. However, cascode amplifier 420 provides a particularly compact embodiment that can still ensure optimal amplifier performance.

To provide loop stability to cascode amplifier 430, an NMOS transistor 413 can be configured with its source, drain, and substrate coupled to voltage Vin (via resistor 418). In this configuration, NMOS transistor 413 can function as a capacitor. Note that other embodiments could include other elements and/or circuits for providing this stabilizing function. For example, in one embodiment, an actual capacitor could replace NMOS transistor 413, wherein the two plates of the capacitor could be formed with two polysilicon layers (or alternatively one polysilicon layer and a heavily doped diffusion) and an intermediate dielectric layer.

The configuration of NMOS transistor 413 as a capacitor can advantageously be formed using a standard CMOS technology. Specifically, NMOS transistor 413 can include an N– well (typically used as a substrate) and one polysilicon layer (typically used for a gate). However, instead of having two P-type doped regions (typically used for a drain and a source), NMOS transistor 413 could include two N+ regions. In this configuration, the N– well and the polysilicon layer can form the two plates of the capacitor. Therefore, NMOS transistor 413 can provide capacitor functionality at a fraction of the cost of a standard capacitor.

In accordance with one feature of the invention, a large voltage gain, defined by the voltage at node 415 divided by the voltage at node 416 (i.e. voltage @ 415/voltage @ 416), can be obtained by optimizing device sizes of NMOS transistors 408, 409, 411, and 412. For example, in one embodiment, NMOS transistors 409 and 412 can be made stronger than NMOS transistors 408 and 411. In one specific implementation, NMOS transistors 408 and 411 can be made with a width of 20 microns and a length of 20 microns, whereas NMOS transistors 409 and 412 can be made with a width of 20 microns and a length of 10 microns. This implementation advantageously keeps the potential of INN and INP relatively close to voltage source VSSA, yet provides a voltage gain of 1000.

The output of cascode amplifier 430, i.e. the voltage at node 415, can drive an NMOS transistor 414 having its source connected to voltage source VSSA as well as its substrate. In this configuration, NMOS transistor 414 can act as a shunt device to prevent the voltage on line 417, i.e. the output of bandgap reference voltage circuit 400, from rising above the bandgap reference voltage.

Figure 5:
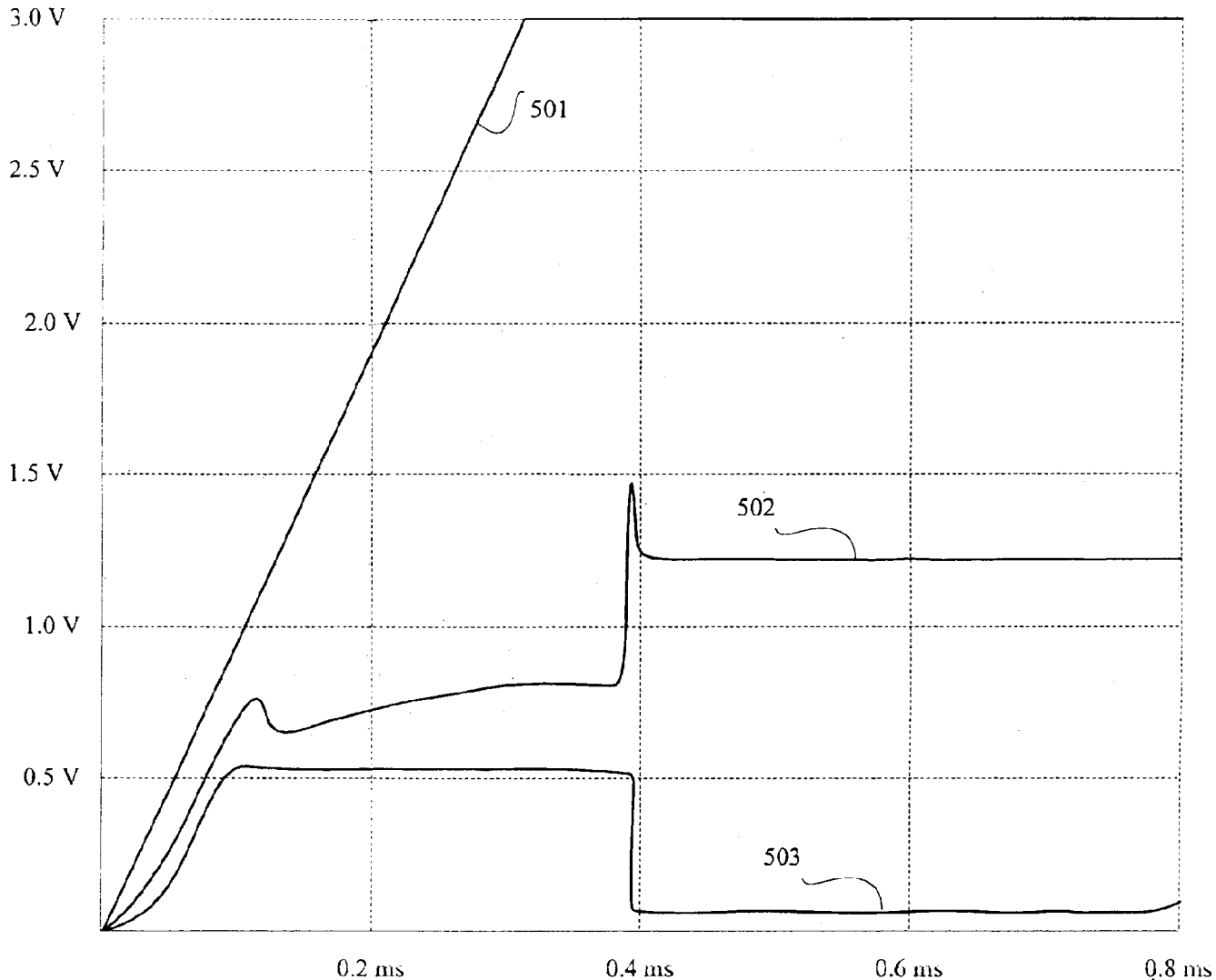
FIG. 5 illustrates exemplary operation of the folded cascode bandgap reference circuit shown in FIG. 4.

FIG. 5 illustrates a graph 500 including various curves that show an exemplary operation of a bandgap reference voltage circuit (e.g. bandgap reference voltage circuit 400 of FIG. 4). For example, curve 501 shows an exemplary power supply to the bandgap reference voltage circuit, which increases from 0 V to 3.0 V in approximately 0.3 ms. Curve 502 shows the output voltage of the bandgap reference voltage circuit. In this embodiment of the bandgap reference voltage circuit, after a settling time for the cascode amplifier of approximately 0.4 ms, the output voltage becomes constant at 1.25 V.

Referring back to FIG. 4, bandgap reference voltage circuit 400 can advantageously run at a very low current (e.g. 5 $\mu$A or less) and start up at a very low voltage (e.g. less than 1.5 V), which is particularly desirable in battery applications. Because the charging current is low, the voltage at node 415 takes approximately 0.4 ms before it is sufficiently high to turn on NMOS transistor 314. Thus, as shown by curve 502 in FIG. 5, the output voltage on line 417 irregularly increases and momentarily spikes to 1.45 V immediately before NMOS transistor 414 turns on. After NMOS transistor 314 turns on, the output voltage on line 417 is pulled down to its desired regulated voltage of 1.25 V.

Curve 503 in FIG. 5 shows the voltage on node 416 (FIG. 4), which corresponds to the voltage on the positive input terminal of cascode amplifier 330. In this embodiment, the voltage on node 416 quickly increases from 0 V to approximately 0.5 V and then maintains this voltage until NMOS transistor 414 is turned on. At this point, as shown by curve 503 in FIG. 5, the voltage on node 416 drops to approximately 0.1 V, which is its regulated voltage.

In this embodiment, curves 502 and 503 were generated under temperature conditions of 27° C. and an input voltage ramp of 3.0 V. However, in accordance with one feature of the invention, the bandgap reference voltage circuit could be advantageously run with different temperatures and input voltages while substantially preserving the regulated voltage response demonstrated by curves 502 and 50.

Figure 6:
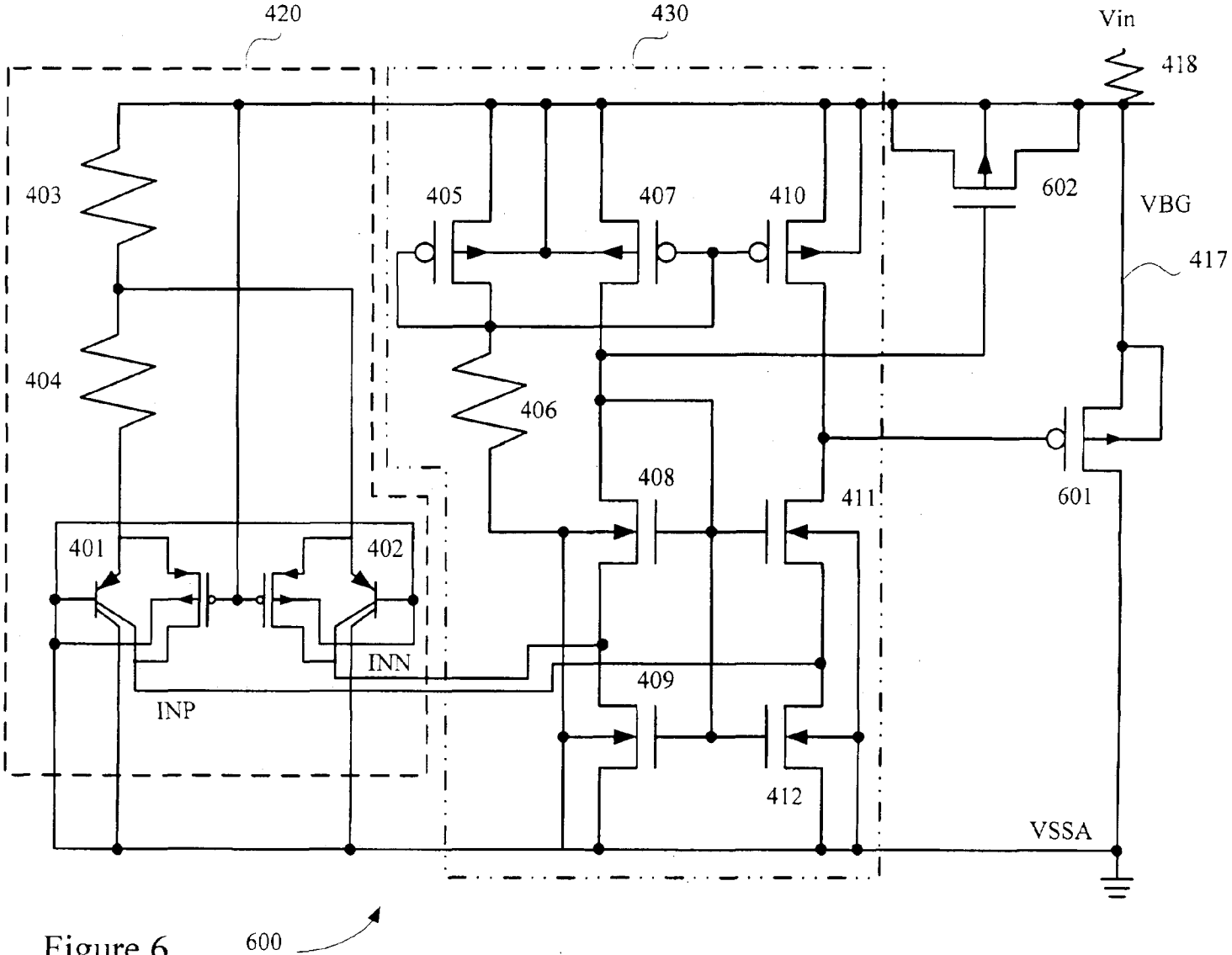
FIG. 6 illustrates another embodiment of a bandgap reference voltage circuit that can be manufactured in CMOS technology while preserving the accuracy of the bandgap reference voltage.

FIG. 6 illustrates another bandgap reference voltage circuit 600 that can be manufactured in CMOS technology while preserving the accuracy of the bandgap reference voltage. In this embodiment, NMOS transistor 414 can be replaced with a PMOS transistor 601 and the positive and negative input terminals of cascode amplifier 430 are reversed. That is, the collector of LPNP transistor 401 is now connected to the positive (INP) input terminal and the collector of LPNP transistor 402 is now connected to the negative (INN) input terminal.

This configuration maintains the same overall polarity/phase in the feedback loop as bandgap reference voltage circuit 400. That is, if the output voltage of the bandgap reference voltage circuit increases (or decreases), then the shunt device and the feedback loop (e.g. line 417) should ensure that the modified Brokaw cell and the cascode amplifier pull that voltage down (or up) to maintain the bandgap voltage.

Note that NMOS transistor 413 can be replaced with an NMOS transistor 602, which is also configured as a capacitor in bandgap reference voltage circuit 600. However, to ensure the appropriate polarity/phase, the gate of NMOS transistor 602 is connected to the drain of PMOS transistor 407.

Although Brokaw cell 420 and cascode amplifier 430 are shown separately for clarity, these circuits can be merged into a configuration including a cascode amplifier. Therefore, the configuration of bandgap reference voltage circuits 400/600 can be thought of as a Brokaw cell that includes a folded cascode amplifier (instead of an operational amplifier) as well as an output shunt device. Of importance, bandgap reference voltage circuits 400/600 can be implemented in CMOS technology (described in reference to FIGS. 7A and 7B).

LPNP Transistors: CMOS Implementation

Figure 7B:
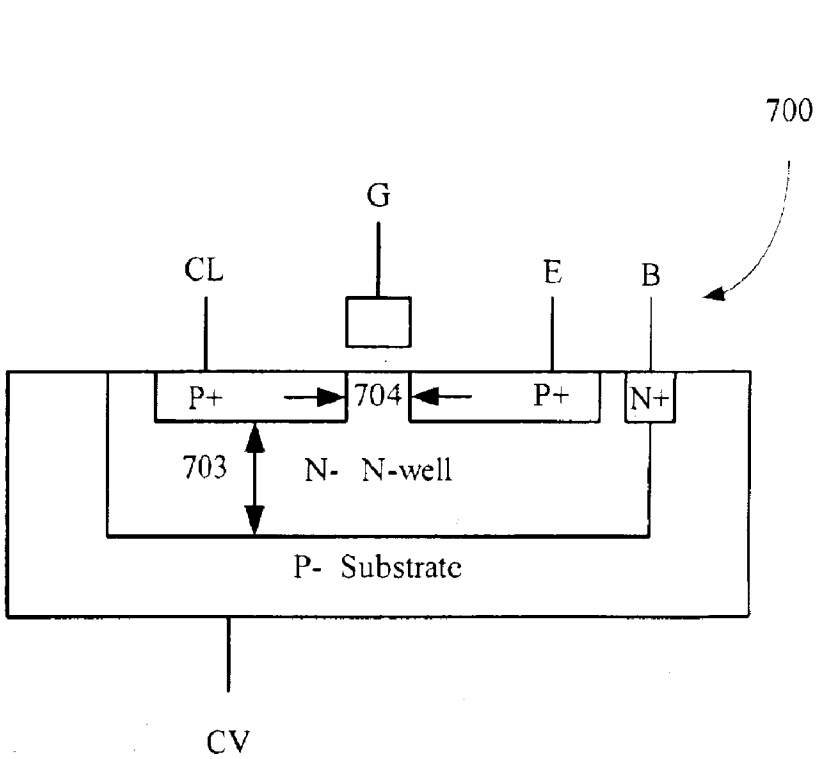
FIG. 7B illustrates an exemplary cross section of the LPNP transistor of FIG. 7A implemented in silicon.
Figure 7A:
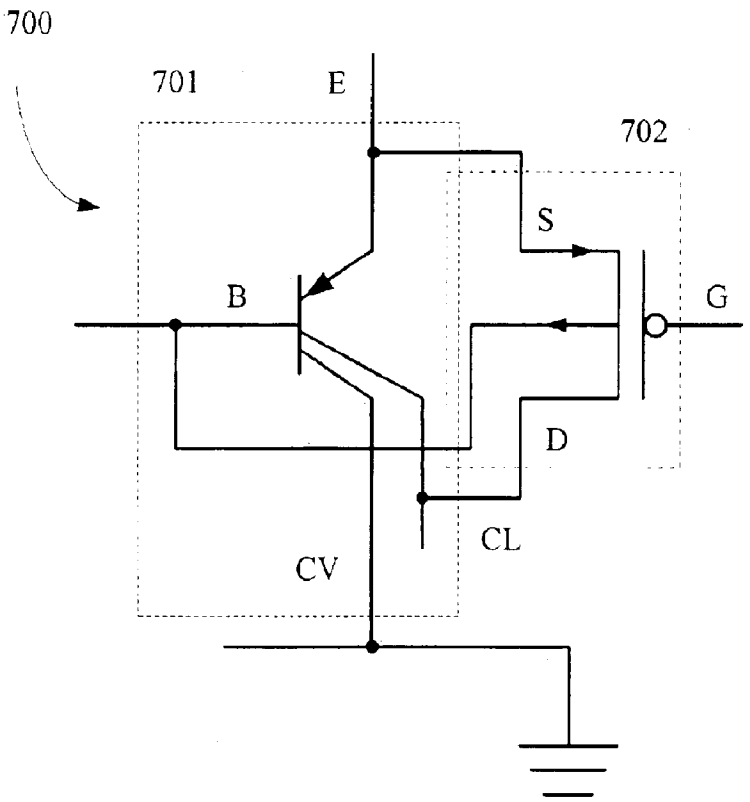
FIG. 7A illustrates a circuit diagram of an exemplary LPNP implemented using a standard CMOS process.

In accordance with one feature of the invention, the LPNP transistors can be advantageously implemented in CMOS technology. FIG. 7A illustrates a circuit diagram of an exemplary LPNP transistor 700 implemented using a standard CMOS process. In general, LPNP transistor 700 includes a base B, an emitter E, a vertical collector CV, a lateral collector CL, and a gate G. Specifically, LPNP transistor 700 includes a PNP transistor 701 and a parasitic PMOS transistor 702.

In this embodiment, the substrate of parasitic PMOS transistor 702 is coupled to the base B of PNP transistor 701. Note that the emitter E and lateral collector CL of PNP transistor 701 are effectively merged into the source S and drain D of parasitic PMOS transistor 702.

In LPNP transistor 700, the lateral collector CL forms an input terminal (i.e. INN or INP) to the folded cascode amplifier, whereas the vertical collector CV is connected to ground. Note that the base B of PNP transistor 701, in addition to being connected to the substrate of PMOS transistor 702, is also coupled to voltage source VSSA (and thus to the substrates of the NMOS transistors in the folded cascode amplifier (e.g. NMOS transistors 408, 409, 411, and 412 of FIGS. 4 and 6). FIG. 7B illustrates a cross section of LPNP transistor 700 implemented in silicon.

In accordance with one feature of the invention, the performance of the vertical PNP device should be different than the performance of the lateral PNP device. To create this performance difference, the width of the base B associated with the lateral collector CL (lateral width 704) is minimized relative to the width of the base B associated with the vertical collector CV (vertical width 703). Of importance, vertical width 703 is determined by the fabrication facility making the chip. However, lateral width 704, which corresponds to width of the gate G, can be reduced by design specification to obtain the appropriate ratio. In one embodiment, vertical width 703 is approximately $2\mu$ whereas the lateral (and gate) width 704 can be reduced to approximately $0.6\mu$ or less (depending on breakdown voltage).

Moreover, to minimize the effect of parasitic PMOS transistor 702 (although optimally eliminated, this parasitic transistor necessarily exists), its gate can be coupled to line 417 (FIGS. 4 and 6), which is the highest positive potential in the bandgap reference circuit (note that line 417 is coupled to VIN via transistor 418). In this manner, the parasitic PMOS transistors are ensured to be non-conducting.

In one embodiment, LPNP transistor 401 can be sized relative to LPNP 402 in a ratio of 8:1. This sizing can create a delta $V_{BE}(\Delta V_{BE})$. This $\Delta V_{BE}$ can be multiplied up by the ratio of resistors 403 and 404. For example, in one embodiment in which resistor 403 has 5× the resistance of resistor 404, resistor 403 would have an associated $10\times\Delta V_{BE}$(i.e. twice the current, as indicated by the arrows at node 450 in FIG. 4, and thus 10× the voltage delta).

Although illustrative embodiments of the invention have been described in detail herein with reference to the figures, it is to be understood that the invention is not limited to those precise embodiments. They are not intended to be exhaustive or to limit the invention to the precise forms disclosed. As such, many modifications and variations will be apparent.

Figure 8:
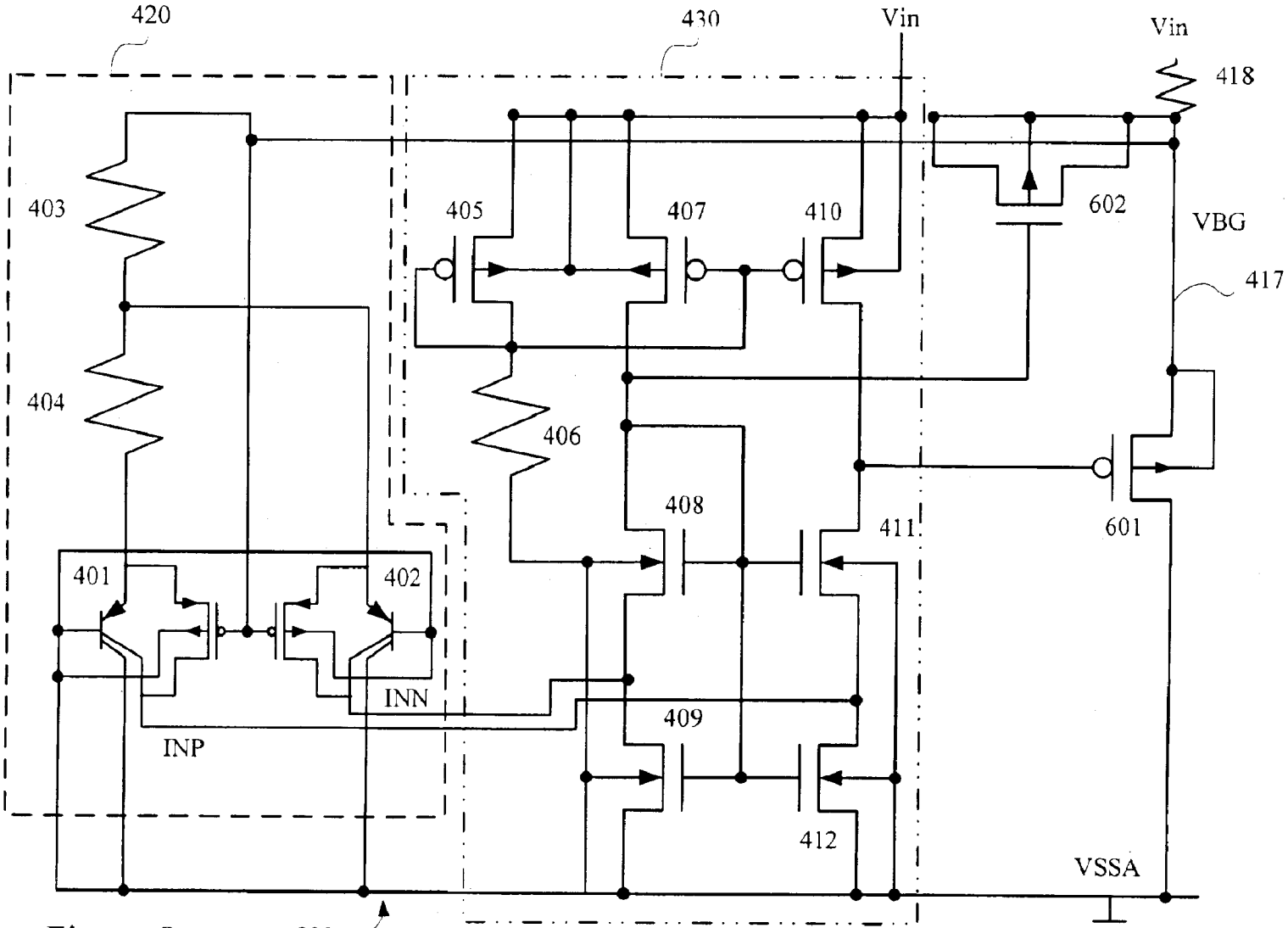
FIG. 8 illustrates a bandgap reference voltage circuit that includes components identical to those in the bandgap reference voltage circuit shown in FIG. 6. In this embodiment, the cascode amplifier can be powered by voltage source Vin.

For example, any amplifier able to operate with a source voltage equal to the bandgap voltage can be used instead of the cascode amplifier described herein. Indeed, even a bandgap reference voltage circuit having an amplifier not sourced by the bandgap voltage can provide advantages compared to a standard bandgap reference voltage circuit. FIG. 8 illustrates a bandgap reference voltage circuit 800 that includes components identical to those in bandgap reference voltage circuit 600. In this embodiment, cascode amplifier 430 receives a power source Vin. Bandgap reference voltage circuit 800, although subject to input voltage variations, is implemented in a very compact manner, thereby providing size advantages compared to standard Brokaw cells.

Figure 9:
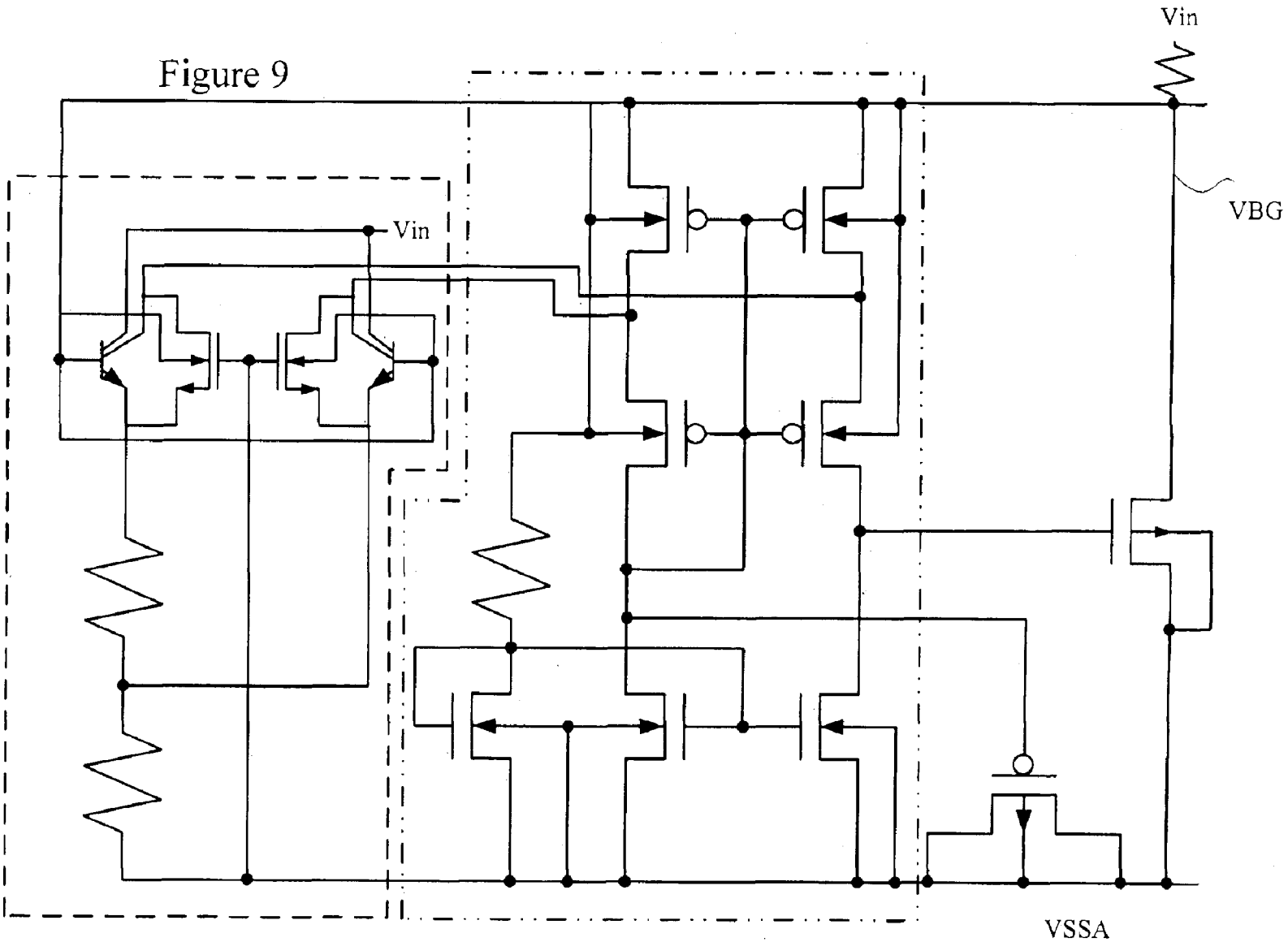
FIG. 9 illustrates a bandgap reference voltage circuit including a Brokaw cell implemented with LNPN transistors.

In other embodiments, the bandgap reference voltage circuit can include a Brokaw cell implemented with LNPN transistors. Note that this embodiment would include an N-type substrate (in contrast to the N-substrate used in bandgap reference voltage circuits 400/600). In this embodiment, shown in FIG. 9, the P-type transistors of bandgap reference voltage circuits 400/600 could be replaced with N-type transistors. Similarly, the N-type transistors bandgap reference voltage circuits 400/600 could be replaced with P-type transistors. Moreover, in this embodiment, the VSSA rail would become the Vin rail and vice versa. Note that in this embodiment, the vertical collectors of the LNPN transistors would be coupled to Vin. Therefore, as Vin changes, the parasitic transistors could affect the lateral (i.e. the primary) transistors, thereby potentially affecting the voltage balance reached by using transistors 401/402.

Note that if mixed technology can be used, e.g. bi-CMOS etc., or if portions of the circuit can be implemented with discrete components, then the LPNP transistors (or the LNPN) transistors could be replaced with standard bipolar PNP (or NPN) transistors. In this embodiment, the merged configuration of the modified Brokaw cell and the cascode amplifier can still provide a reduced circuit size compared to standard Brokaw cells. In yet other embodiments using advanced process technology, the lateral transistors described above could be replaced by vertical transistors, thereby achieving the performance advantages described in reference to bandgap reference voltage circuits 400/600.

Of importance, bandgap reference voltage circuits 400/600, which are three-terminal circuits, can be considered as shunt regulators, i.e. two-terminal circuits, with another terminal added via resistor 418 (or alternatively a current source, which is not shown).

In other embodiments, resistor 418 (FIGS. 4 and 6) can be replaced with a current source to increase performance, although with an associated increase in cost. Accordingly, it is intended that the scope of the invention be defined by the following claims and their equivalents.

What is claimed is:

1. A bandgap reference voltage circuit comprising:

a modified Brokaw cell including a first transistor and a second transistor, each transistor including:

a bipolar transistor having a base, an emitter, and a lateral collector; and a parasitic transistor having a source coupled to the emitter of the bipolar transistor, a drain coupled to the lateral collector of the bipolar transistor, and a substrate coupled to the base of the bipolar transistor; and a cascode amplifier, wherein the lateral collectors of the first and second transistors in the modified Brokaw cell are folded into input terminals of the cascode amplifier.

2. A bandgap reference voltage circuit comprising:

a modified Brokaw cell including a first transistor and a second transistor, each transistor including a base, an emitter, and a collector; and a cascode amplifier, wherein collectors of the first and second transistors in the modified Brokaw cell are folded into input terminals of the cascode amplifier, wherein an output of the bandgap reference voltage circuit provides a source voltage to the cascode amplifier.

3. The bandgap reference voltage circuit of claim 2, wherein the first and second transistors comprise lateral PNP transistors.

4. The bandgap reference voltage circuit of claim 1, further including a stabilizing device for providing loop stability to the cascode amplifier.

5. The bandgap reference voltage circuit of claim 4, wherein the stabilizing device includes a transistor configured with its source, drain, and substrate coupled to an input voltage source and its gate coupled to the cascode amplifier.

6. The bandgap reference voltage circuit of claim 4, wherein the stabilizing device includes a capacitive device having one terminal coupled to an input voltage source and another terminal coupled to the cascode amplifier.

7. The bandgap reference voltage circuit of claim 1, wherein the cascode amplifier includes a bias circuit coupled in operative relation to the Brokaw cell.

8. The bandgap reference voltage circuit of claim 1, further including an output shunt device coupled to receive an output of the cascode amplifier, wherein the shunt device generates a regulated output of the bandgap reference voltage circuit.

9. The bandgap reference voltage circuit of claim 1, wherein the modified Brokaw cell and the cascode amplifier are implemented in CMOS technology.

10. The bandgap reference voltage circuit of claim 1, wherein the first and second transistors include lateral NPN transistors.

11. The bandgap reference voltage circuit of claim 1, further including one of a resistance and a current source coupled to the output of the bandgap reference voltage circuit.

12. A shunt regulator comprising:

a modified Brokaw cell including a first transistor and a second transistor, each transistor including:

a bipolar transistor having a base, an emitter, and a lateral collector; and a parasitic transistor having a source coupled to the emitter of the bipolar transistor, a drain coupled to the lateral collector of the bipolar transistor, and a substrate coupled to the base of the bipolar transistor; and a cascode amplifier, wherein the lateral collectors of the first and second transistors in the modified Brokaw cell are folded into input terminals of the cascode amplifier.

13. A shunt regulator comprising:

a modified Brokaw cell including a first transistor and a second transistor, each transistor including a base, an emitter, and a collector; and a cascade amplifier, wherein collectors of the first and second transistors in the modified Brokaw cell are folded into input terminals of the cascode amplifier, wherein an output of the shunt regulator provides a source voltage to the cascode amplifier.

14. The shunt regulator of claim 12, wherein the first and second transistors comprise lateral PNP transistors.

15. The shunt regulator of claim 12, further including a stabilizing device for providing loop stability to the cascade amplifier.

16. The shunt regulator of claim 15, wherein the stabilizing device includes a transistor configured with its source, drain, and substrate coupled to an input voltage source and its gate coupled to the cascode amplifier.

17. The shunt regulator of claim 15, wherein the stabilizing device includes a capacitive device having one terminal coupled to an input voltage source and another terminal coupled to the cascode amplifier.

18. The shunt regulator of claim 12, wherein the cascode amplifier includes a bias current circuit coupled in operative relation to the Brokaw cell.

19. The shunt regulator of claim 12, further including an output shunt device coupled to receive an output of the cascade amplifier, wherein the shunt device generates a regulated output of the shunt regulator.

20. The shunt regulator of claim 12, wherein the modified Brokaw cell and the cascode amplifier are implemented in CMOS technology.

21. The shunt regulator of claim 12, wherein the first and second transistors include lateral NPN transistors.

22. A cascode amplifier comprising:

a bias current circuit connected to a regulated voltage source;

a first NMOS transistor;

a second NMOS transistor, a third NMOS transistor; and a fourth NMOS transistor, wherein a drain of the first NNOS transistor is connected to a source of the third NMOS transistor and to a first input terminal of the cascode amplifier, a drain of the second NMOS transistor is connected to a source of the fourth NMOS transistor and a second input terminal of the cascode amplifier, and sources of the first and second NMOS transistors are connected to a low voltage source VSS, wherein substrates of the first, second, third, and fourth NMOS transistors are connected to VSS, wherein gates of the first, second, third, and fourth NMOS transistors and a drain of the third NMOS transistor are connected to a common node, which is connected to a bias current source, and wherein a drain of the fourth NMOS transistor is connected to an output terminal of the cascode amplifier.

23. The cascode amplifier of claim 22, wherein the bias current circuit includes:

a first PMOS transistor;

a second PMOS transistor;

a third PMOS transistor; and a resistor, wherein substrates and sources of the first, second, and third PMOS transistors are connected to the regulated voltage source, wherein the resistor is coupled between VSS and gates of the first, second, and third PMOS transistors, and wherein a drain of the first PMOS transistor is connected to the resistor, a drain of the second PMOS transistor is connected to the common node, and a drain of the third PMOS transistor is connected to the output terminal of the cascode amplifier.

* * * * *